United States Patent [19]

Ichioka

[11] Patent Number: 4,690,243

[45] Date of Patent: Sep. 1, 1987

[54] ELEVATOR CONTROL APPARATUS

[75] Inventor: Youichi Ichioka, Tokyo, Japan

[73] Assignee: Mitsubishi Denki Kabushiki Kaisha, Tokyo, Japan

[21] Appl. No.: 881,212

[22] Filed: Jul. 1, 1986

[30] Foreign Application Priority Data

Jul. 8, 1985 [JP] Japan ..... 60-149738

[51] Int. Cl.[4] ..... B66B 1/18

[52] U.S. Cl. ..... 187/101; 364/900

[58] Field of Search ..... 187/101, 102; 364/900

[56] References Cited

U.S. PATENT DOCUMENTS 4,193,478 3/1980 Keller et al. ..... 187/101

4,345,670 8/1982 Kaneko et al. ..... 187/102

4,410,959 10/1983 Tajima et al. ..... 364/900

4,509,143 4/1985 Tajima et al. ..... 364/900

*Primary Examiner*—William M. Shoop, Jr.

*Assistant Examiner*—W. E. Duncanson, Jr.

*Attorney, Agent, or Firm*—Leydig, Voit & Mayer

[57] ABSTRACT

Standard operating sequences for standard operations set for the service of an elevator are stored in a read only memory unit while special operating sequences for special operations are stored in a random access memory unit. The elevator operating steps are determined in accordance with the standard and special sequences and are modified by an input unit coupled to the random access memory so that modifications of the operating steps in the service of the elevator can be facilitated.

8 Claims, 11 Drawing Figures

FIG. 8(a)
PRIOR ART
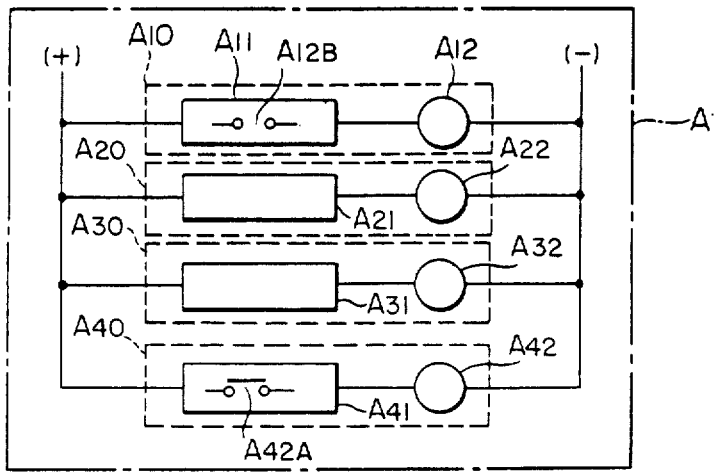
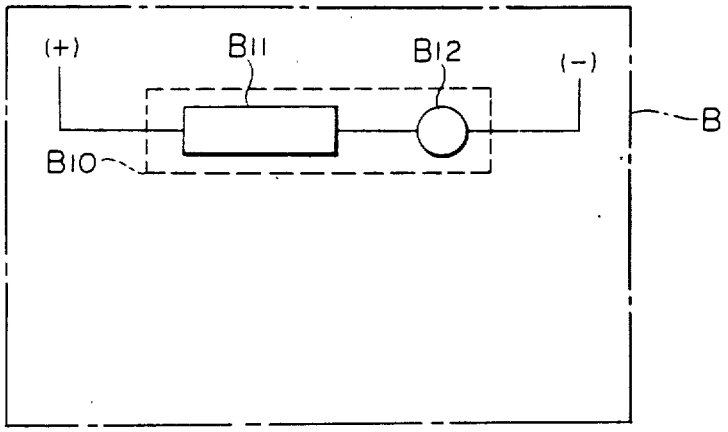
FIG. 8(b)
PRIOR ART

ELEVATOR CONTROL APPARATUS

BACKGROUND OF THE INVENTION

This invention relates to an elevator control apparatus for controlling the service of an elevator, and more particularly to an elevator control apparatus which can readily add or modify operating steps in the service of the elevator when there is a change in the control requirement from one mode of control to another.

A prior-art apparatus of this type is described in Japanese Patent Application Laid-open No. 56-99504, and the circuit block diagram thereof is shown in FIG. 6.

Referring to the figure, the prior-art control apparatus for an elevator comprises a central processing unit (hereinbelow, termed 'CPU') 1 for determining operating steps necessary for an elevator service on the basis of state and control signals supplied from operating devices 5 and in accordance with predetermined sequences stored in a memory unit 2. The memory unit 2 includes a standard-mode ROM 21 for storing sequences to be applied in standard operations and a modified-mode ROM 23 for storing sequences to be applied in special operations. A contact memory unit 3 is further provided to store data of relay contact states in the final operation of the elevator controlled by the CPU 1 while a coil memory unit 4 is provided to store data of the relay coil states of the operating steps determined by the CPU 1 on the basis of the data stored in the contact memory unit 3 and the state and control signals supplied from the operating devices 5. An input data memory unit 6 temporarily holds the state and control signals output from the devices 5 while an output data memory unit 7 temporarily holds, under the control of the CPU 1, data of the relay coil states stored in the coil memory unit 4. A main bus 8 connects the aforementioned units so as to transfer the data and signals therebetween.

Next, the operation of the prior-art apparatus based on the above arrangement will be described with reference to FIGS. 7 to 10. FIG. 7 shows an operational flow chart relating to the operations of various elements shown in FIG. 6 in which arrows in solid lines indicate the flows of data or signals, while the arrows in broken lines indicate the flows of the operations. To start (START) the operations, the CPU 1 is first initialized (INITL) to send clear signals to the contact memory unit 3 (RELAY CONTACT STATES OPERATION) and coil memory unit 4 (RELAY COIL STATES OPERATION) to clear the data of relay contact states used in a preceding service so as to eliminate the influence thereof on the new service. When state signals and control signals of the elevator devices 5 are input (INPUT OPERATION) and temporarily stored (DATA INPUT OPERATION) the input data memory unit 6. The operating steps necessary for the elevator service are simulated by the CPU 1 on the basis of these state and control signals and according to the standard-mode (STANDARD-MODE DECISION OPERATION) or the modified-mode (MODIFIED-MODE DECISION OPERATION). The data of relay coil states are then stored in the coil memory unit 4 (RELAY COIL STATES OPERATION).

In a case where the CPU 1 has decided from the state signals and control signals that the operations of the elevator are standard, the operating steps are determined by only the standard sequences stored in the standard-mode ROM 21. If, on the other hand, the CPU 1 has decided that special operations of the elevator are in progress, the special sequences stored in the modified-mode ROM 23 are included in the determination of the operating steps.

On the basis of the operating steps stored in the coil memory unit 4, the CPU 1 calculates operation command signals and display signals and stores them in the output data memory unit 7 as output data and delivers them to the operating devices 5 (OUTPUT OPERATION) so as to cause the elevator to perform predetermined operations. In addition, the CPU 1 transmits (TRANSMITTING OPERATION) the relay coil states currently stored in the coil memory unit 4 to the contact memory unit 3 as the relay contact states of the final operation of the elevator and stores them therein (RELAY CONTACT STATES OPERATION).

The elevator control apparatus therefore controls the service of the elevator under the condition that the special sequences stored in the modified-mode ROM 23 remains unchanged during the current and subsequent service operations.

Next, the relation between the standard and special sequences will be described in detail with reference to FIGS. 8(*a*) and 8(*b*). As illustrated in FIG. 8(*a*), the standard sequences A successively simulates processing units formed of relay circuits A10–A40 having a plurality of relay contact circuits A11–A41 and relay coils A12–A42. Each relay contact circuit includes a pair of contacts (for example, contacts A12A and A12B for circuit A11) so that when the corresponding relay coil (A12 in the example) is energized, one contact is closed and the other opened, depending on the state of the relay coil. For illustration purposes, the contact A12B is closed in the relay contact circuit A11 while the contact A42A is opened in the relay contact circuit A41. It is also noted that, in FIG. 7, only relay coil A22 and the contacts A22A and A22B of relay circuit A20 are represented for simplicity. In FIG. 8(*b*), which illustrates the special sequences B, only one processing unit formed of relay circuit B10 is represented to include a relay contact circuit B11 and a relay coil B12. Other processing units of similar construction and corresponding to other processing units A20–A40 of the standard sequences A are omitted for simplicity. Since the relay contact circuits provide the function of detecting a "hall call" to stop the elevator cage at the floor corresponding to the hall call while the cage is running, they are hereinafter referred to as the stoppage determining circuits of the relay coils. One such stoppage determining circuit in the standard sequence A, which operates between a first floor and a fifth floor, is described in detail with reference to FIG. 9.

Referring to the figure, reference symbols (+) and (−) designate a DC power source and A22 a hall call stoppage determining relay coil. The stoppage determining circuit A21 comprises cage position relay contacts 1F–4F which are closed when the cage approaches the first floor–fourth floor, respectively. Similarly, cage position relay contacts 2G–5G are relay contacts for the second floor–fifth floor. Reference numerals 1U–4U designate up call relay contacts which are closed when respective up hall calls on the first floor–fourth floor have been registered, 2D–5D designate down call relay contacts which are closed when respective down hall calls on the second floor–fifth floor have been registered, and 6A and 6B designate control relay contacts which are closed during normal operation of the elevator cage. "Up" service relay contact 7B is closed during an upward operation of the cage and, similarly, a down service relay contact 8B is closed during a downward operation of the cage. "Up" travel relay contact 9A is closed during the travel of the cage in an upward direction and, similarly, a down travel relay contact 10A is closed during the travel of the cage in a downward direction. The hall call stoppage determining relay coil $A_{22}$ generates a command signal for stopping the elevator cage in response to the registration of a hall call when the relay coil A22 is energized.

With the above circuit arrangement, when an up hall call is made at, for instance, the third floor and the cage, in normal (standard) operation, traveling in the upward direction approaching the third floor, the hall call stoppage determining relay coil $A_{22}$ is energized by a circuit extending along (+)-(3F)-(3U)-(6A)-(9A)-($A_{22}$)-(−), and the cage commences deceleration for stopping at the third floor in accordance with known car stopping and leveling circuitry (not shown). When the cage is traveling in the upward direction and no up hall call is made, and, therefore, upward operation is not needed, the up service relay contact 7B is closed, and the cage is stopped by a circuit extending along (+)-(7B)-(9A)-($A_{22}$)-(−).

In most elevators, this circuit arrangement is used for the hall call stoppage determination. However, in a manually operated elevator which is provided with passage buttons, a circuit arragenment shown in FIG. 10 containing partial modification becomes necessary.

The circuit in FIG. 10 is also a hall call stoppage determining circuit for an elevator to be used in special operation. In the figure, symbol $B_{12}$ denotes a hall call stoppage determining relay coil for generating a command signal for stopping the elevator cage in response to the registration of a hall call when the relay coil B12 is energized, and symbols 12A and 12B denote passage (non-stop) relay contacts which are opened when a passage button has been depressed in the cage. The remaining elements are the same as in FIG. 9. In this case, when an up hall call is made at the third floor, and the cage, in normal operation, is traveling in the upward direction approaching the third floor, if the passage relay contact 12A is pressed open, the hall call stoppage determining relay coil B12 will not be energized and the cage passes the third floor without stopping.

Thus, when the elevator is required to operate in a manner different from the standard operation, modifications to the elevator control circuit are necessary. These modifications, such as the addition of the "non-stop" mode, may be effected by the addition of further switches and relays to the standard control circuit.

In the prior-art example described above, the standard and special sequences are all stored in the read only memories 21 and 23 of the memory unit 2 shown in FIG. 6.

This has led to the problem that the special sequence steps are fixed, so the elevator can no longer be operated under a special mode requiring variable special sequence steps. Furthermore, the storage of the special sequences in the read only memory unit brings about the disadvantage that the memory unit itself needs to be separately prepared for replacement or that a ROM wrtier dedicated to writing data is required.

SUMMRY OF THE INVENTION

This invention has been made in order to eliminate the problems mentioned above, and has for its object to provide an elevator control apparatus in which special operating steps capable of coping with all the situations of an elevator are written and stored on occasion without requiring the replacement of a memory unit itself or the use of a dedicated ROM writer, whereupon the elevator can be operated on the basis of the operation steps.

The elevator control apparatus according to this invention is so constructed that standard operations set for the service of an elevator are stored in a read only memory unit, while special sequences of operations of the elevator service other than the standard operations are set and stored in a random access memory unit so that the operating steps of the elevator are determined in accordance with the standard and special modes of operation.

The elevator control apparatus in this invention stores the standard special sequences in the read only memory unit and stores the modified special operational sequences in the random access memory unit under the control of control calculation mens or external input means, whereby operating steps corresponding to state signals and control signals applied from the devices of the elevator are determined in accordance with the modified sequences, and the control calculation means operates the elevator on the basis of the operating steps.

BRIEF DESCRIPTION OF THE DRAWINGS

FIG. 8(*a*) is a relay circuit diagram of the standard operational sequences, while FIG. 8(*b*) is a relay circuit diagram of the special operational sequences;

In the drawings, the same symbols indicate identical or corresponding portions.

DETAILED DESCRIPTION OF THE INVENTION

Figure 1:
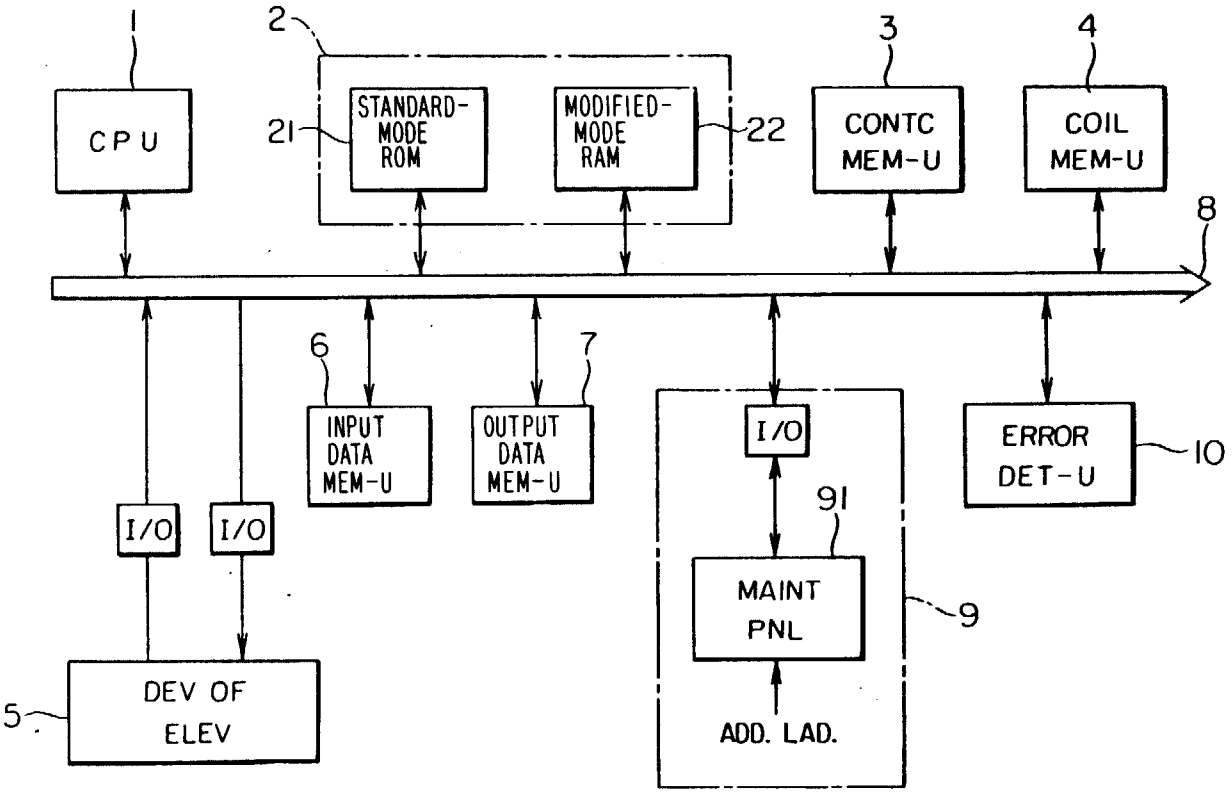
FIG. 1 is a general circuit block diagram of an embodiment of this invention.

Now, an embodiment of this invention will be described with reference to FIGS. 1 to 5. Shown in FIG. 1 is the general circuit block diagram of a preferred embodiment. Referring to the figure, the elevator control apparatus according to the present invention comprises, in addition to the arrangement of the prior-art apparatus described above a modified mode change/-display unit 9 to modify and display special sequences stored in a RAM 22 which takes the place of the modified mode ROM 23 shown in FIG. 6). Further included is an error detection unit 10 to check for errors in the special sequences stored in the modified-mode RAM 22.

Figure 7:
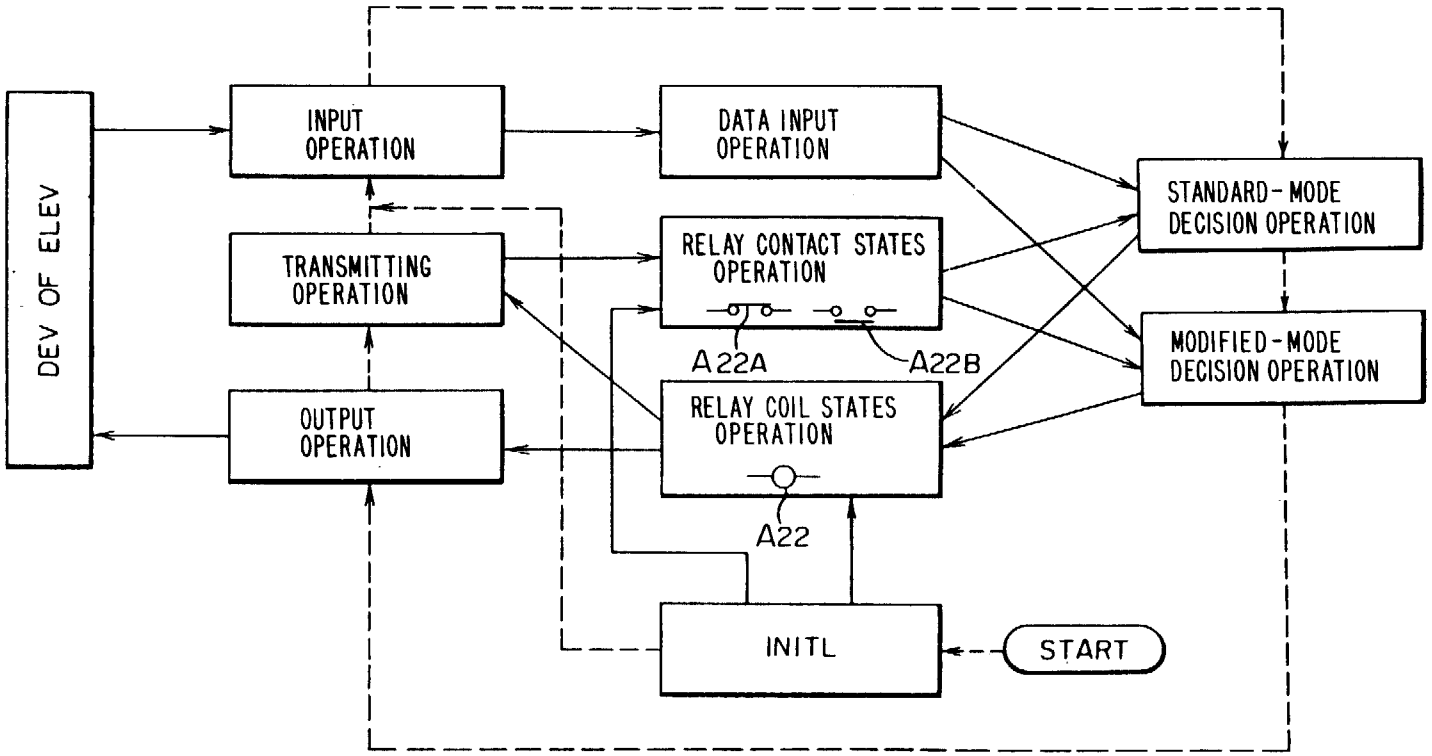
FIG. 7 PRIOR ART
FIG. 7 is a diagram of the prior-art apparatus corresponding to FIG. 2.
Figure 9:
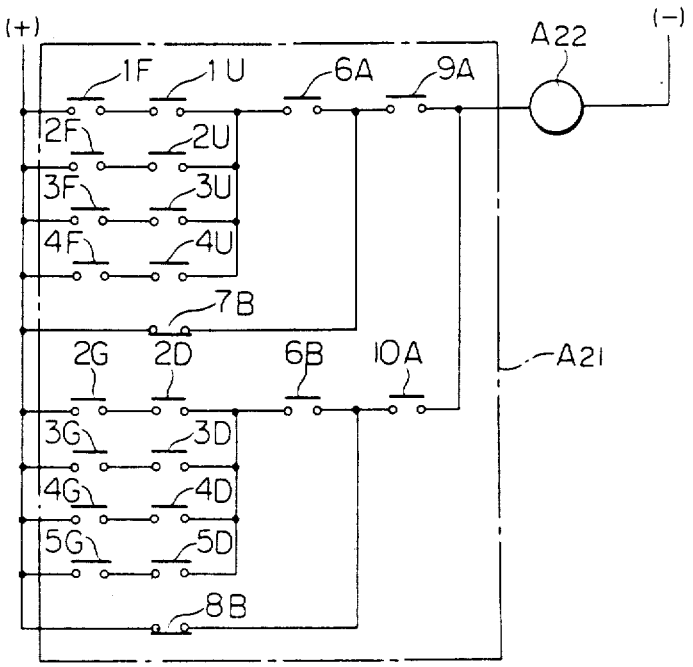
FIG. 9 PRIOR ART
FIG. 9 is a diagram of one relay circuit for operation in the standard sequences.
Figure 10:
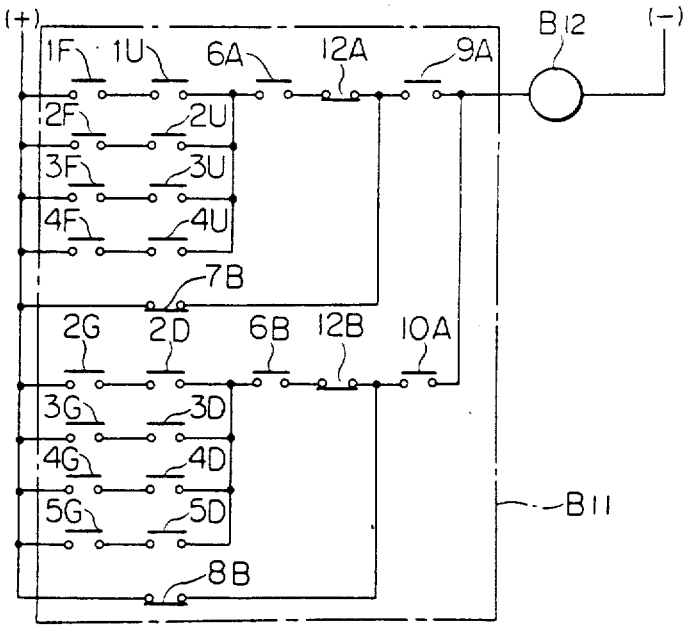
FIG. 10 PRIOR ART
FIG. 10 is a diagram of one relay circuit for operation in the special sequences.

The operation of the elevator control apparatus according to this embodiment will now be described with reference to FIG. 2 which shows an operational flow chart of various elements shown in FIG. 1 concerning the transfer of data and signals therebetween. It is noted that, as in FIG. 7, the solid arrows indicate the flow of data or signals while the arrows in broken line indicate the flow of operations between corresponding elements. However, as clearly shown, the operation of detecting the special sequence errors and the operation of correcting them are different from the operations of the prior-art apparatus.

Figure 3:
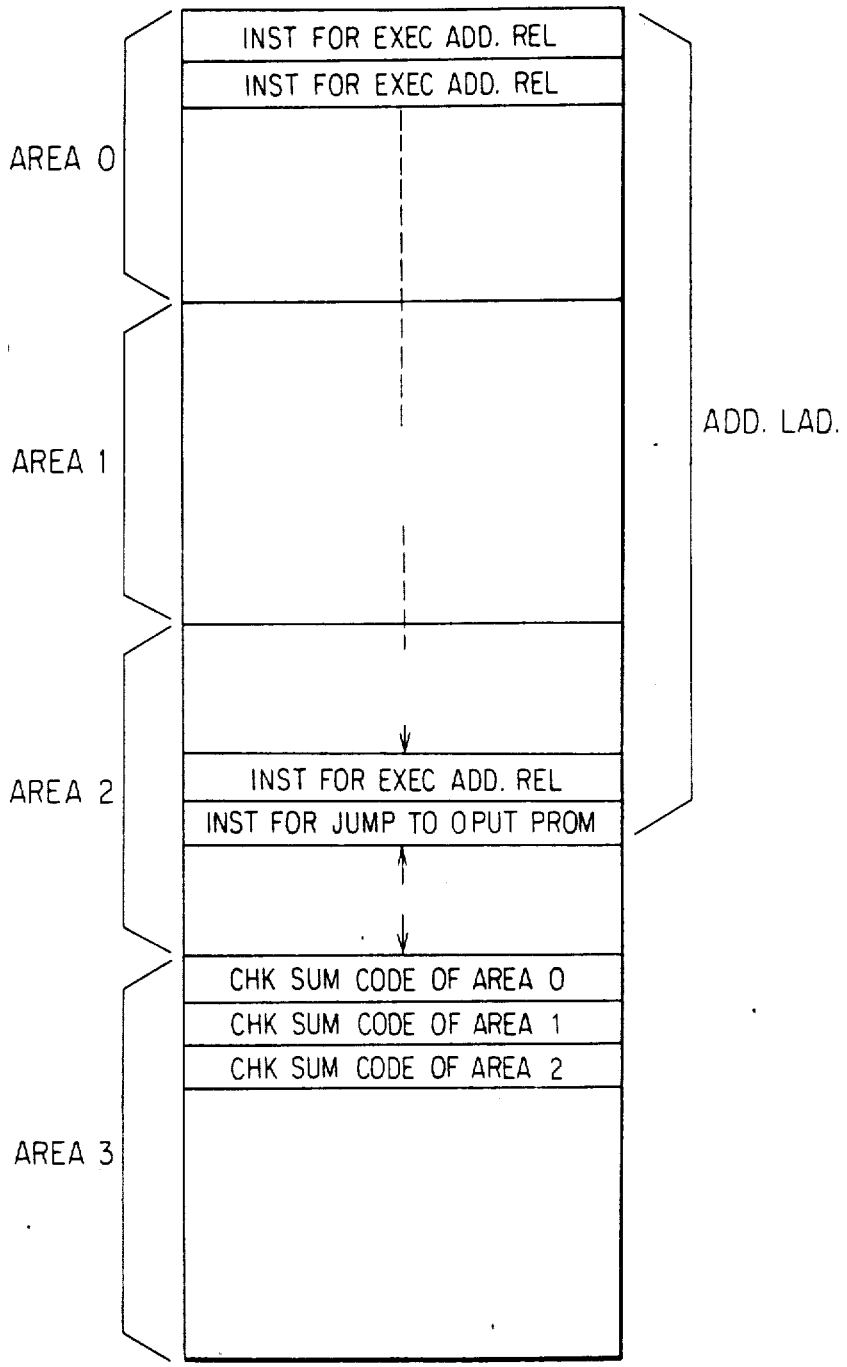
FIG. 3 is a memory map of special operational sequences.

Besides, FIG. 3 shows the memory map of the special sequences in the modified-mode RAM 22. This memory map is divided into Area 0, Area 1, Area 2 and Area 3 for respective predetermined capacities. Instructions for running the special sequences are stored in the areas 0–2, and the check sum codes of the areas 0–2 are stored in the area 3.

Figure 4:
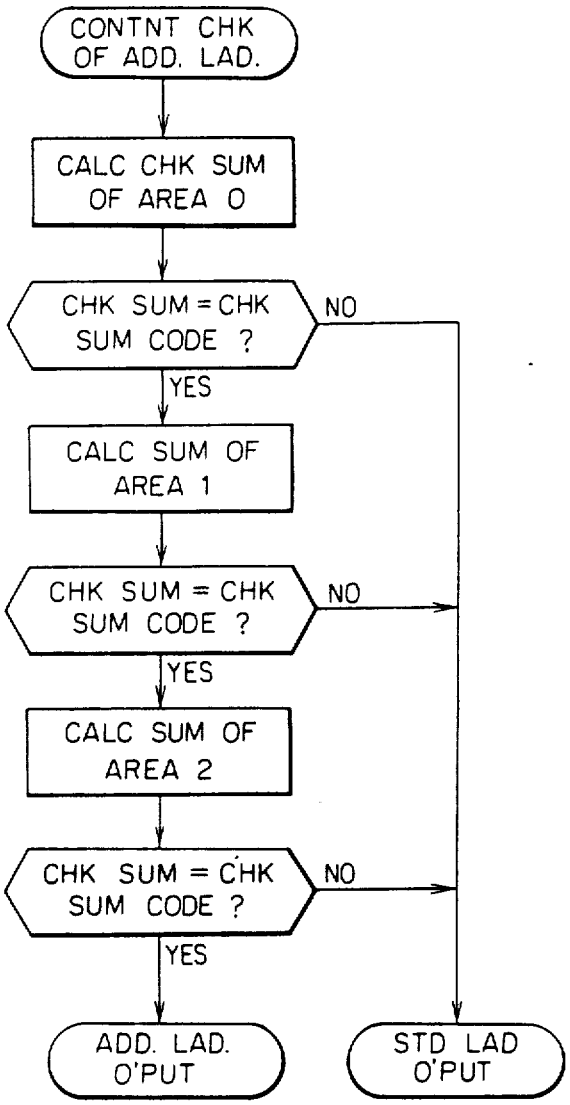
FIG. 4 is a flow chart of the error check of the special operational sequences.

FIG. 4 shows a flow chart for the case of performing the error check of the special sequences stored in the modified-mode RAM 22.

Figure 2:
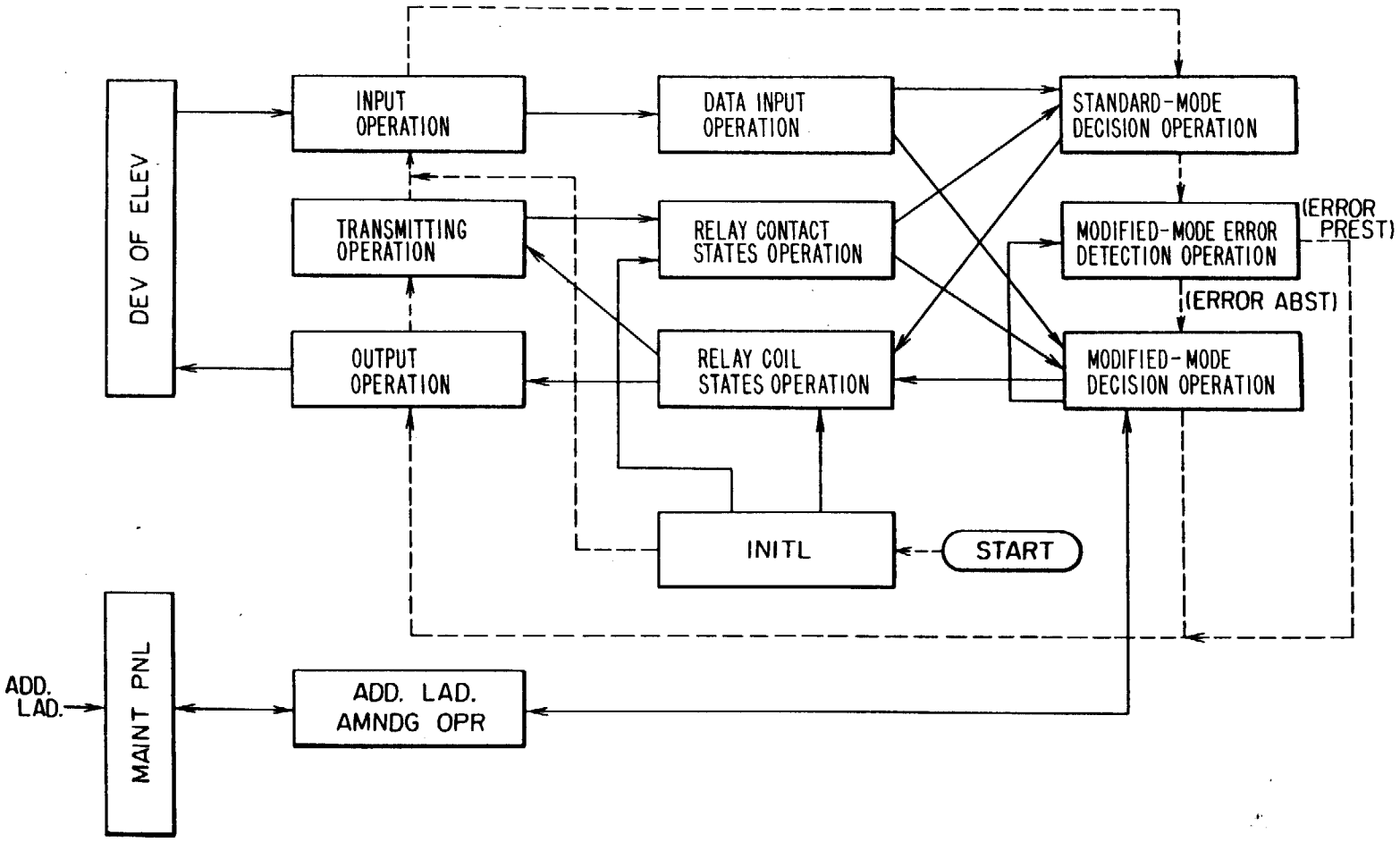
FIG. 2 is a flow chart of the operations of the various constituents of the apparatus shown in FIG. 1.

Referring to FIGS 2 to 4, the error check of the modified mode RAM 22 is carried out as follows. When the error detection unit 10 is started by the command of the CPU 1, the check sums of the memory areas 0 to 2 are calculated and compared with the respective check sum codes of the areas 0 to 2 stored in the area 3. If any of the check sums does not agree, the special sequences in the modified-mode RAM 22 are not executed. That is, the control flow jumps to the output program. If all the calculated results of the check sums agree with the check sum codes, operating steps based on the special sequences in the modified-mode RAM 22 are performed.

As stated above, in the case where no error has been detected by the error check of the special sequences stored in the modified-mode RAM 22, the standard operating sequence in the standard-mode ROM 21 is executed and the special sequence is thereafter executed as stated in the explanation of the prior-art example. Therefore, the control process of the relay circuit of the special sequence becomes valid.

As a result, the operation of the contact circuit $B_{11}$ after the modification becomes valid.

On the other hand, in the case where an error has been detected, the stoppage determination of the special sequence is not performed, so that the modification process becomes invalid. As a result, the standard operation of the contact circuit $A_{21}$ becomes valid.

In this manner, when an error has been detected in the special sequence stored in the modified-mode RAM 22, the standard operating sequence is validated.

Figure 5:
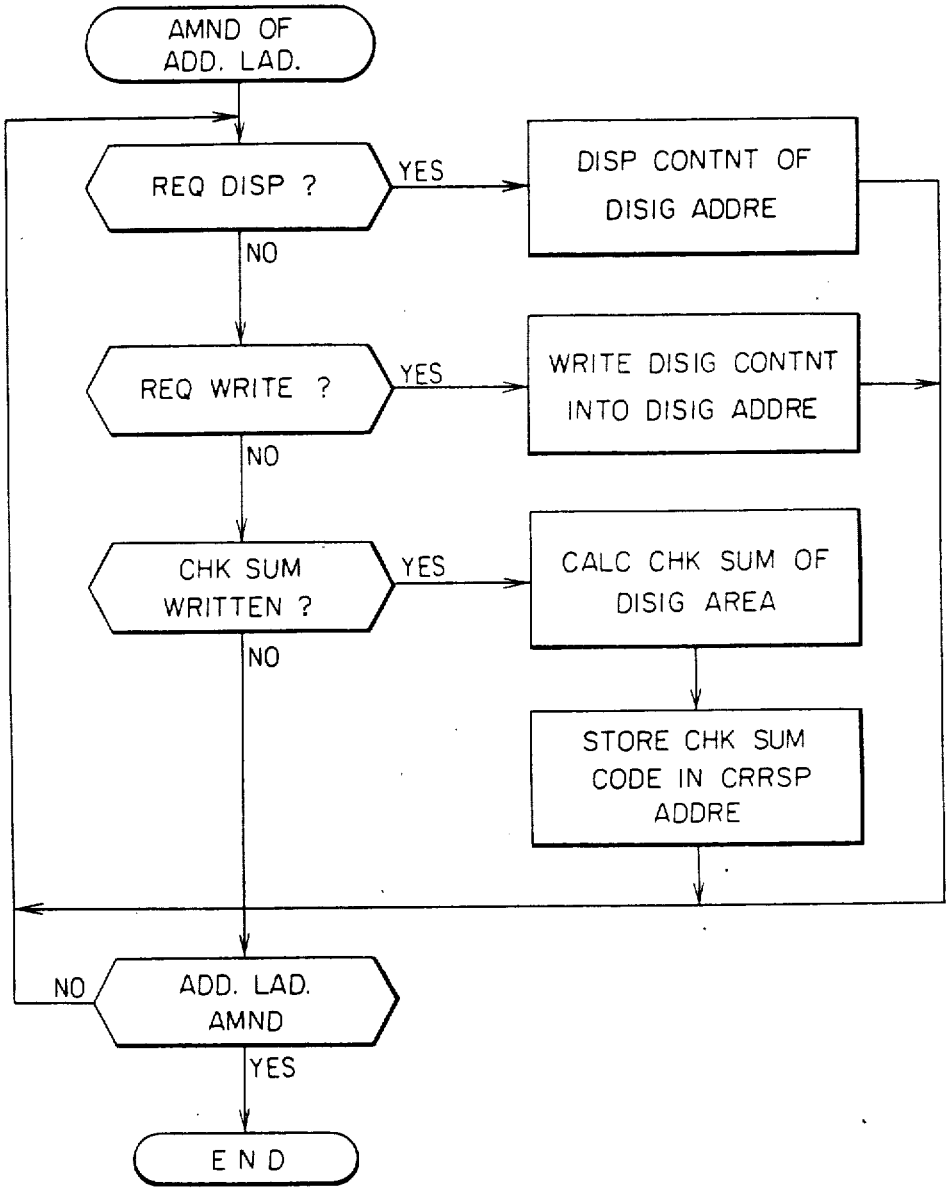
FIG. 5 is a flow chart of the amendment of the special operational sequences.
Figure 6:
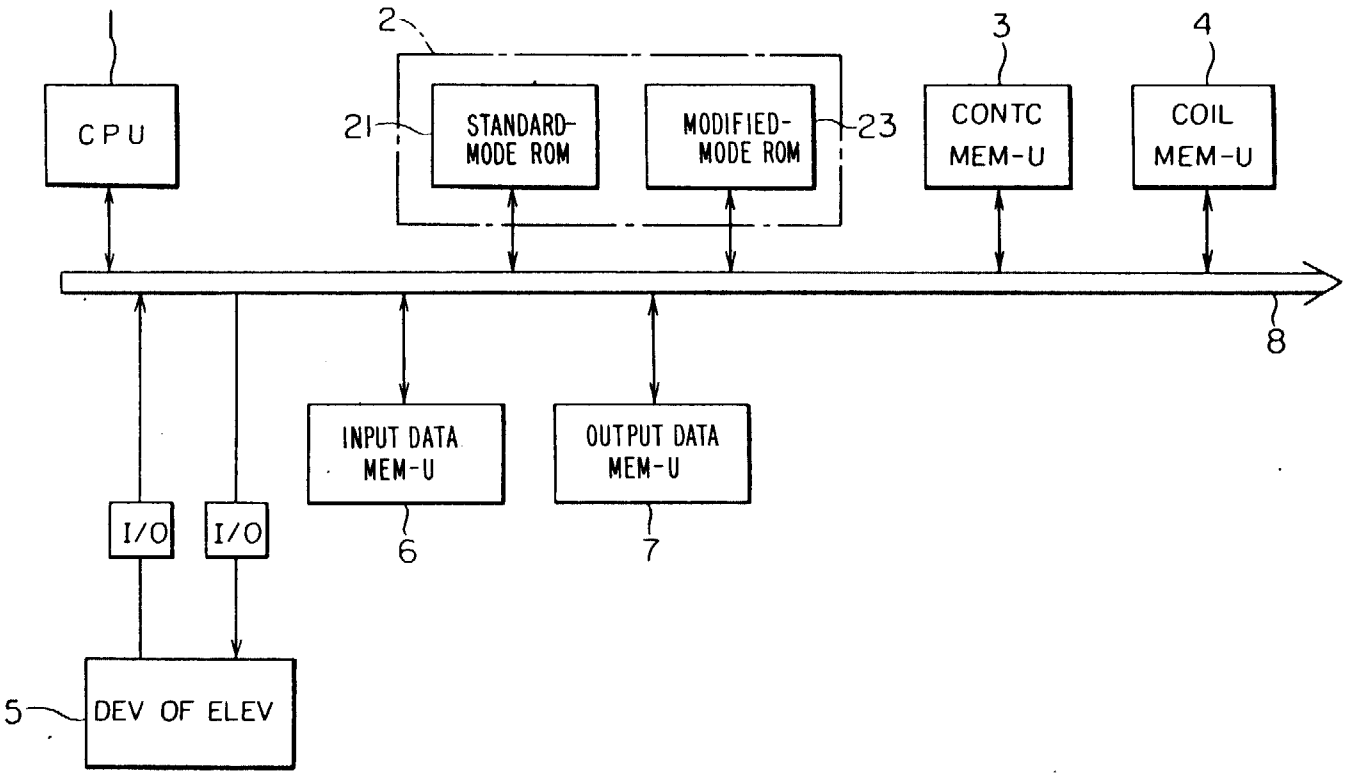
FIG. 6 PRIOR ART
FIG. 6 is a general circuit block diagram of a prior-art apparatus.

FIG. 5 shows a flow chart of a modification to the special sequence. In the modified-mode change/display unit 9, in order to store the special sequence in the modified-mode RAM 22 anew or to modify it, the operations of the switches of a maintenance panel 91 are executed, and the lamps of the maintenance panel 91 are lit up to display the operating steps of the elevator. In the description of the present embodiment, the operation of the modified-mode change/display unit 9 based on this flow chart is separately started when the CPU 1 is not executing the operation control of the elevator.

When the control flow of the modified special sequence is started, the operations of the various switches of the maintenance panel 91 are executed. In a case where the maintenance panel 91 has a display request switch or a write request switch in an 'on state', the check sum of that area in the memory map of the special sequence which is designated by this switch is detected by the error detection unit 10, and the check sum code is written in a predetermined memory area. On the other hand, in a case where neither of the request switches is turned 'on' or where the above operation has ended, the same operation is repeatedly executed until either request switch is turned 'on'.

In this manner, the contents to be stored in the modified-mode RAM 22 can be displayed and written and the check sum code can be written by the modified-mode change/display unit 9 and the error detection unit 2, so that the special sequence can be readily amended or written into the modified-mode RAM 22.

The above embodiment is so constructed that the modification to the special sequence is made when the CPU 1 is not executing the operation control of the elevator or by interrupting this operation control. However, a construction is also possible in which the CPU 1 is operated in a time sharing basis, and the modification operation of the special sequence is performed simultaneously with the conrol operations of the elevator illustrated in broken lines in FIG. 2. The performance of the special sequence modification operation is effective to prevent the degradation of the service quality of the elevator and to facilitate debugging in the special operating sequence steps of the elevator.

Besides, the embodiment is so constructed that, owing to the error check of the special sequence stored in the modified-mode RAM 22, the special sequence is considered invalid even when only partly erroneous. However, a construction is also possible in which portions are checked for check sums and are provided for respective additional relays constituting the special sequence and, the error of each additional relay is checked by the corresponding check portion to consider the additional relay with the error detected as being invalid. In this case, the additional relays with no error detected are considered valid and can form the operating steps of the elevator. When the additional relays are considered valid, the structure of the modified-mode RAM 22 is determined, the check sum codes of the special sequence are created and the special sequence is modified by operations similar to those of the foregoing embodiment.

As described above, the elevator control apparatus according to this invention is so constructed that a standard operating sequence in which standard operations are set as to the service of an elevator is stored in a read only memory unit, while a special sequence in which the operations of the elevator service other than the standard operating sequence are set is stored in a random access memory unit. The operating steps of the elevator are determined according to the standard and special sequences, and that the elevator is operated by the operating steps. This construction achieves the effect that special operating steps capable of coping with all the situations of the elevator can be written and stored on occasion without requiring the replacement of the memory unit itself or the use of a dedicated ROM writer, whereby the elevator can be operated on the basis of the operating steps, and the content of the special sequence can be readily modified.

What is claimed is:

1. A control apparatus for an elevator comprising control calculation means receiving state and control signals from a plurality of operating devices of the elevator to determine operating steps necessary for an elevator service in accordance with a selected mode of operation among standard and special sequences, ladder memory means for storing said standard and special sequences, contact memory means for storing data representing relay contact states, and coil memory means for storing data representing operating states of respective relay coils on the basis of the data of relay contact states and said state and control signals, said ladder memory means including a read only memory for storing said standard sequences and a random access memory for storing said special sequences.

2. An elevator control apparatus according to claim 1 further comprising an error detection unit for detecting errors of data written into said random access memory and, when an error has been detected, the data representing operating states of said relay coils are supplied to said operating devices of the elevator.

3. An elevator control apparatus according to claim 2 wherein:

said random access memory has a plurality of information areas for storing instructions to execute said special sequences and a check area for storing check sum codes set for said plurality of information areas in order to detect errors, and said error detection unit calculates check sums in said plurality of information areas, compares the calculated check sums with the check sum codes in said check area, and determines the absence or presence of an error on the basis of the results of the comparisons.

4. An elevator control apparatus according to claim 3 wherein, when the absence of an error is determined, said control calculation means executes said standard sequences and thereafter executes said special sequences so as to determine the operation steps for the elevator service.

5. An elevator control apparatus according to claim 1 further comprising a modified-mode input unit coupled to said random access memory for modifying said special sequences stored therein.

6. An elevator control apparatus according to claim 5 wherein said modified-mode input unit comprises a maintenance panel for displaying said special sequences.

7. An elevator control apparatus according to claim 6 wherein said modified-mode input unit further includes a plurality of switches provided on said maintenance panel and operable in cooperation with said control calculation means to modify said elevator operating steps.

8. An elevator control apparatus according to claim 7 wherein said modified-mode input unit modifies elevator operating steps only when said control calculation means is not performing an operation control of the elevator.

* * * * *